US011231238B2

(12) United States Patent
Inagaki

(10) Patent No.: US 11,231,238 B2
(45) Date of Patent: Jan. 25, 2022

(54) HEAT EXCHANGER

(71) Applicant: DENSO CORPORATION, Kariya (JP)

(72) Inventor: Ryuichirou Inagaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 42 days.

(21) Appl. No.: 16/892,621

(22) Filed: Jun. 4, 2020

(65) Prior Publication Data

US 2020/0292249 A1 Sep. 17, 2020

Related U.S. Application Data

(63) Continuation of application No. PCT/JP2018/044371, filed on Dec. 3, 2018.

(30) Foreign Application Priority Data

Dec. 8, 2017 (JP) ..... JP2017-236168

(51) Int. Cl.

| | |
|---|---|
| ***F28D 1/02*** | (2006.01) |
| ***F28F 1/02*** | (2006.01) |
| ***F28D 1/053*** | (2006.01) |
| ***F28F 1/40*** | (2006.01) |
| ***F28F 9/00*** | (2006.01) |
| ***F28F 9/013*** | (2006.01) |

(Continued)

(52) U.S. Cl.

CPC ..... *F28F 1/02* (2013.01); *F28D 1/053* (2013.01); *F28F 1/40* (2013.01); *F28F 9/001* (2013.01); *F28F 9/0131* (2013.01); *F25B 39/022* (2013.01); *F25B 39/04* (2013.01); *F28D 2021/0084* (2013.01); *F28D 2021/0085* (2013.01)

(58) Field of Classification Search

CPC ..... F28F 1/02; F28F 1/40; F28F 9/001; F28F 9/0131; F28D 1/053; F28D 2021/0084; F28D 2021/0085; F25B 39/022; F25B 39/04

USPC ..... 165/152

See application file for complete search history.

(56) References Cited

U.S. PATENT DOCUMENTS 5,553,377 A 9/1996 Hirano et al.
5,638,897 A 6/1997 Hirano et al.
(Continued)

FOREIGN PATENT DOCUMENTS

CN 1093161 A 10/1994
CN 1940454 A 4/2007
(Continued)

*Primary Examiner* — Davis D Hwu
(74) *Attorney, Agent, or Firm* — Harness, Dickey & Pierce, P.L.C.

(57) ABSTRACT

A heat exchanger includes plural heat exchange units arranged in series in a flowing direction of external fluid. A tube of the heat exchange units has a tube body and a protrusion. A dimension of the protrusion in a tube stacking direction is smaller than a dimension of the tube body in the tube stacking direction. A dimension of the protrusion in an air flowing direction is larger than a thickness of the tube body. An outer fin is joined to both the upstream tube and the downstream tube arranged in the air flowing direction. The protrusion of the upstream tube is connected to an upstream end of the tube body in the air flowing direction. The protrusion of the downstream tube is connected to a downstream end of the tube body in the air flowing direction.

4 Claims, 4 Drawing Sheets

(51) Int. Cl.

| | |
|---|---|
| *F25B 39/02* | (2006.01) |
| *F25B 39/04* | (2006.01) |
| *F28D 21/00* | (2006.01) |

(56) References Cited

U.S. PATENT DOCUMENTS

| | | | | |
|---|---|---|---|---|
| 5,730,215 | A | 3/1998 | Hirano et al. | |
| 5,749,144 | A | 5/1998 | Hirano et al. | |
| 5,931,226 | A | 8/1999 | Hirano et al. | |
| 2004/0206481 | A1 | 10/2004 | Inaba | |
| 2005/0133210 | A1* | 6/2005 | Inagaki | F28F 19/06 165/152 |
| 2007/0071920 | A1 | 3/2007 | Muto et al. | |
| 2007/0095514 | A1 | 5/2007 | Inoue et al. | |
| 2008/0000626 | A1* | 1/2008 | Sugito | F28D 1/05366 165/173 |
| 2009/0266510 | A1* | 10/2009 | Reynolds | F24H 3/0429 165/47 |
| 2014/0318170 | A1 | 10/2014 | Katoh et al. | |
| 2015/0107813 | A1 | 4/2015 | Omae et al. | |

FOREIGN PATENT DOCUMENTS

| | | | |
|---|---|---|---|
| DE | 842212 | C | 6/1952 |
| JP | H04138566 | U | 12/1992 |
| JP | 2000062446 | A | 2/2000 |
| JP | 2004263997 | A | 9/2004 |
| JP | 2007120888 | A | 5/2007 |
| JP | 2009264664 | A | 11/2009 |
| JP | 2013139995 | A | 7/2013 |
| JP | 2013215736 | A | 10/2013 |

* cited by examiner

HEAT EXCHANGER

CROSS REFERENCE TO RELATED APPLICATION

The present application is a continuation application of International Patent Application No. PCT/JP2018/044371 filed on Dec. 3, 2018, which designated the U.S. and claims the benefit of priority from Japanese Patent Application No. 2017-236168 filed on Dec. 8, 2017. The entire disclosures of all of the above applications are incorporated herein by reference.

TECHNICAL FIELD

The present disclosure relates to a heat exchanger.

BACKGROUND

A heat exchanger has a heat exchange section configured by alternately stacking plural tubes and plural outer fins. The tube includes an inner fin for increasing the contact area with internal fluid inside the tube body through which the internal fluid flows.

SUMMARY

According to an aspect of the present disclosure, a heat exchanger configured to exchange heat between an external fluid and an internal fluid includes a plurality of heat exchange units arranged in series with respect to a flowing direction of the external fluid. Each of the plurality of heat exchange units includes: a plurality of tubes in which the internal fluid flows; and a plurality of outer fins joined to an outer surface of the tube to increase a heat exchange area with the external fluid. The tube has a tube body formed in a tubular shape, in which the internal fluid flows, and a protrusion connected to one end of the tube body in the flowing direction of the external fluid. A length dimension of the protrusion in a stacking direction of the tubes is smaller than a length dimension of the tube body in the stacking direction. A length dimension of the protrusion in the flowing direction of the external fluid is larger than a thickness of the tube body. The plurality of heat exchange units includes: an upstream unit arranged on the most upstream side in the flowing direction of the external fluid; and a downstream unit arranged downstream of the upstream unit in the flowing direction of the external fluid. The tubes forming the upstream unit is defined as an upstream tube and the tubes forming the downstream unit is defined as a downstream tube. Each of the outer fins is joined to both the upstream tube and the downstream tube arranged in the flowing direction of the external fluid. The protrusion of the upstream tube is connected to an upstream end of the tube body in the flowing direction of the external fluid, and the protrusion of the downstream tube is connected to a downstream end of the tube body in the flowing direction of the external fluid.

According to another aspect of the present disclosure, a heat exchanger configured to exchange heat between an external fluid and an internal fluid includes a plurality of heat exchange units arranged in series with respect to a flowing direction of the external fluid. Each of the plurality of heat exchange units includes a plurality of tubes in which the internal fluid flows, and a plurality of outer fins joined to an outer surface of the tube to increase a heat exchange area with the external fluid. The plurality of heat exchange units includes an upstream unit arranged on the most upstream side in the flowing direction of the external fluid and a downstream unit arranged downstream of the upstream unit in the flowing direction of the external fluid. The tubes forming the upstream unit is defined as an upstream tube. The tubes forming the downstream unit is defined as a downstream tube. Each of the outer fins is joined to both the upstream tube and the downstream tube arranged in the flowing direction of the external fluid. A cross-sectional shape of the upstream tube perpendicular to a longitudinal direction of the upstream tube is symmetric with respect to a center line parallel to the flowing direction of the external fluid. A thickness of an upstream end portion of the upstream tube in the flowing direction of the external fluid is larger than a thickness of the other portion of the upstream tube. The downstream tube has a tube body formed in a tubular shape, in which the internal fluid flows, and a protrusion connected to a downstream end of the tube body in the flowing direction of the external fluid. A length dimension of the protrusion in a stacking direction of the tubes is smaller than a length dimension of the tube body in the stacking direction. A length dimension of the protrusion in the flowing direction of the external fluid is larger than a thickness of the tube body.

DESCRIPTION OF EMBODIMENT

Figure 1:
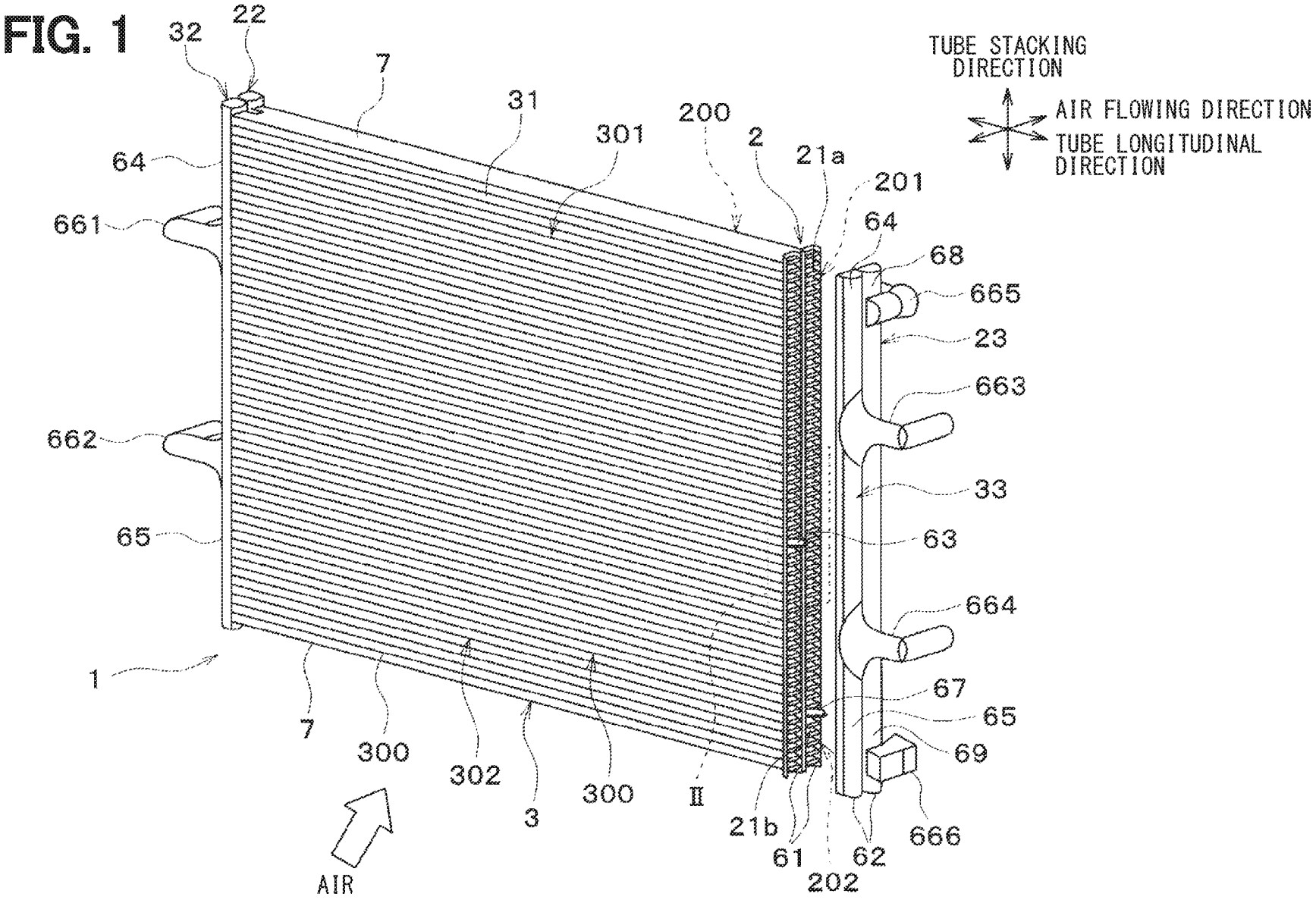
FIG. 1 is a perspective view illustrating a heat exchanger according to a first embodiment.

A heat exchanger has a heat exchange section configured by alternately stacking plural tubes and plural outer fins. The tube includes an inner fin for increasing the contact area with internal fluid inside the tube body through which the internal fluid flows.

The tube body is formed by bending a single plate member. Specifically, the tube body has a curved end formed by folding the plate member, a pair of flat portions arranged to face each other, and a protrusion (that is, a crimped portion). The protrusion is formed by folding one end of the plate member on the opposite side of the curved end and by crimping the other end of the plate member and the end of the inner fin by the folded end of the plate member.

Two heat exchange units are arranged in series with respect to the flowing direction of air which is an external fluid. The tubes forming a heat exchange unit arranged on the upstream side in the air flow are referred to as an upstream tube, and the tubes forming a heat exchange unit arranged on the downstream side in the air flow are called as a downstream tube.

The same refrigerant flows through the upstream tube and the downstream tube. The protrusion is connected to the end of the tube body on the downstream side in the air flow, in both the upstream tube and the downstream tube.

Thereby, the drainage of condensed water can be improved in each of the upstream tube and the downstream tube, because a step is formed between the protrusion and the flat portion in the tube. The condensed water that has flowed to the step can be discharged by the flow of air.

An outer fin is joined to both the upstream tube and the downstream tube arranged side by side in the air flowing direction. Thereby, heat conduction is performed between the upstream tube and the downstream tube via the outer fin. Therefore, heat is exchanged between the upstream heat exchange unit and the downstream heat exchange unit. That is, heat exchange can be realized between the internal fluid flowing through the upstream tube and the internal fluid flowing through the downstream tube.

However, in such a heat exchanger, as described above, if the protrusion is positioned at the downstream end of the tube body in the air flow in both the upstream tube and the downstream tube, the following situation can happen.

That is, a distance between the most downstream portion of the joint between the upstream tube and the outer fin in the air flow and the most upstream portion of the joint between the downstream tube and the outer fin in the air flow becomes long. Therefore, the thermal conductivity between the upstream tube and the downstream tube may deteriorate. The thermal conductivity between two cores arranged in series in the air flowing direction may deteriorate.

The present disclosure provides a heat exchanger to improve heat conductivity between heat exchange units arranged in series in a flowing direction of an external fluid.

According to an aspect of the present disclosure, a heat exchanger configured to exchange heat between an external fluid and an internal fluid includes a plurality of heat exchange units arranged in series with respect to a flowing direction of the external fluid. Each of the plurality of heat exchange units includes: a plurality of tubes in which the internal fluid flows; and a plurality of outer fins joined to an outer surface of the tube to increase a heat exchange area with the external fluid. The tube has a tube body formed in a tubular shape, in which the internal fluid flows, and a protrusion connected to one end of the tube body in the flowing direction of the external fluid. A length dimension of the protrusion in a stacking direction of the tubes is smaller than a length dimension of the tube body in the stacking direction. A length dimension of the protrusion in the flowing direction of the external fluid is larger than a thickness of the tube body. The plurality of heat exchange units includes: an upstream unit arranged on the most upstream side in the flowing direction of the external fluid; and a downstream unit arranged downstream of the upstream unit in the flowing direction of the external fluid. The tubes forming the upstream unit is defined as an upstream tube and the tubes forming the downstream unit is defined as a downstream tube. Each of the outer fins is joined to both the upstream tube and the downstream tube arranged in the flowing direction of the external fluid. The protrusion of the upstream tube is connected to an upstream end of the tube body in the flowing direction of the external fluid, and the protrusion of the downstream tube is connected to a downstream end of the tube body in the flowing direction of the external fluid.

Accordingly, the distance between the most downstream portion of the joint between the upstream tube and the outer fin in a flow of external fluid and the most upstream portion of the joint between the downstream tube and the outer fin in the flow of external fluid becomes shorter. Therefore, the thermal conductivity between the upstream tube and the downstream tube can be improved, so that the thermal conductivity between the plural heat exchange units arranged in series with respect to the flowing direction of the external fluid can be improved.

According to another aspect of the present disclosure, a heat exchanger configured to exchange heat between an external fluid and an internal fluid includes a plurality of heat exchange units arranged in series with respect to a flowing direction of the external fluid. Each of the plurality of heat exchange units includes a plurality of tubes in which the internal fluid flows, and a plurality of outer fins joined to an outer surface of the tube to increase a heat exchange area with the external fluid. The plurality of heat exchange units includes an upstream unit arranged on the most upstream side in the flowing direction of the external fluid and a downstream unit arranged downstream of the upstream unit in the flowing direction of the external fluid. The tubes forming the upstream unit is defined as an upstream tube. The tubes forming the downstream unit is defined as a downstream tube. Each of the outer fins is joined to both the upstream tube and the downstream tube arranged in the flowing direction of the external fluid. A cross-sectional shape of the upstream tube perpendicular to a longitudinal direction of the upstream tube is symmetric with respect to a center line parallel to the flowing direction of the external fluid. A thickness of an upstream end portion of the upstream tube in the flowing direction of the external fluid is larger than a thickness of the other portion of the upstream tube. The downstream tube has a tube body formed in a tubular shape, in which the internal fluid flows, and a protrusion connected to a downstream end of the tube body in the flowing direction of the external fluid. A length dimension of the protrusion in a stacking direction of the tubes is smaller than a length dimension of the tube body in the stacking direction. A length dimension of the protrusion in the flowing direction of the external fluid is larger than a thickness of the tube body.

Accordingly, the distance between the most downstream portion of the joint between the upstream tube and the outer fin in a flow of external fluid and the most upstream portion of the joint between the downstream tube and the outer fin in the flow of external fluid becomes shorter. Therefore, the thermal conductivity between the upstream tube and the downstream tube can be improved, so that the thermal conductivity between the plural heat exchange units arranged in series with respect to the flowing direction of the external fluid can be improved.

Hereinafter, embodiments for implementing the present disclosure will be described referring to drawings. In the respective embodiments, parts corresponding to matters already described in the preceding embodiments are given reference numbers identical to reference numbers of the matters already described. The same description is therefore omitted depending on circumstances. In the case where only a part of the configuration is described in each embodiment, the other embodiments described above can be applied to the other part of the configuration. The present disclosure is not limited to combinations of embodiments which combine parts that are explicitly described as being combinable. As long as no problem is present, the various embodiments may be partially combined with each other even if not explicitly described.

First Embodiment

A first embodiment will be described with reference to FIGS. 1 to 5. In FIG. 1, illustration of outer fins 5 described later is omitted.

A heat exchanger 1 shown in FIG. 1 is a part of a heat pump cycle (not shown) of an air conditioner for a vehicle. The heat pump cycle of the present embodiment has a refrigerant circuit in which refrigerant circulates and a cooling water circuit in which cooling water circulates.

The refrigerant circuit is provided by a vapor compression refrigeration cycle. The refrigerant circuit is provided to perform a heating operation for heating air to the cabin and a cooling operation for cooling air to the cabin by switching the flow paths. The refrigerant circuit is provided to perform a defrosting operation by which frost on an outdoor heat exchanger 2 is melted and removed while the outdoor heat exchanger 2 functions as an evaporator that evaporates the refrigerant during the heating operation.

The outdoor heat exchanger 2 exchanges heat between low-pressure refrigerant flowing inside and air. The outdoor heat exchanger 2 is arranged in the engine room. The outdoor heat exchanger 2 functions as an evaporator that evaporates the low-pressure refrigerant and exerts an endothermic effect during the heating operation. The outdoor heat exchanger 2 functions as a radiator for radiating the high-pressure refrigerant during the cooling operation. The outdoor heat exchanger 2 is configured integrally with a radiator 3. The radiator 3 exchanges heat between cooling water in the cooling water circuit and air.

Hereinafter, the heat exchanger in which the outdoor heat exchanger 2 and the radiator 3 are integrally configured is referred to as the heat exchanger 1 or composite heat exchanger 1.

The heat exchanger 1 has the radiator 3 and the outdoor heat exchanger 2 as a plurality of heat exchange units arranged in series in a flowing direction of air, which is an external fluid. The radiator 3 corresponds to an upstream unit. The outdoor heat exchanger 2 corresponds to a downstream unit.

Figure 2:
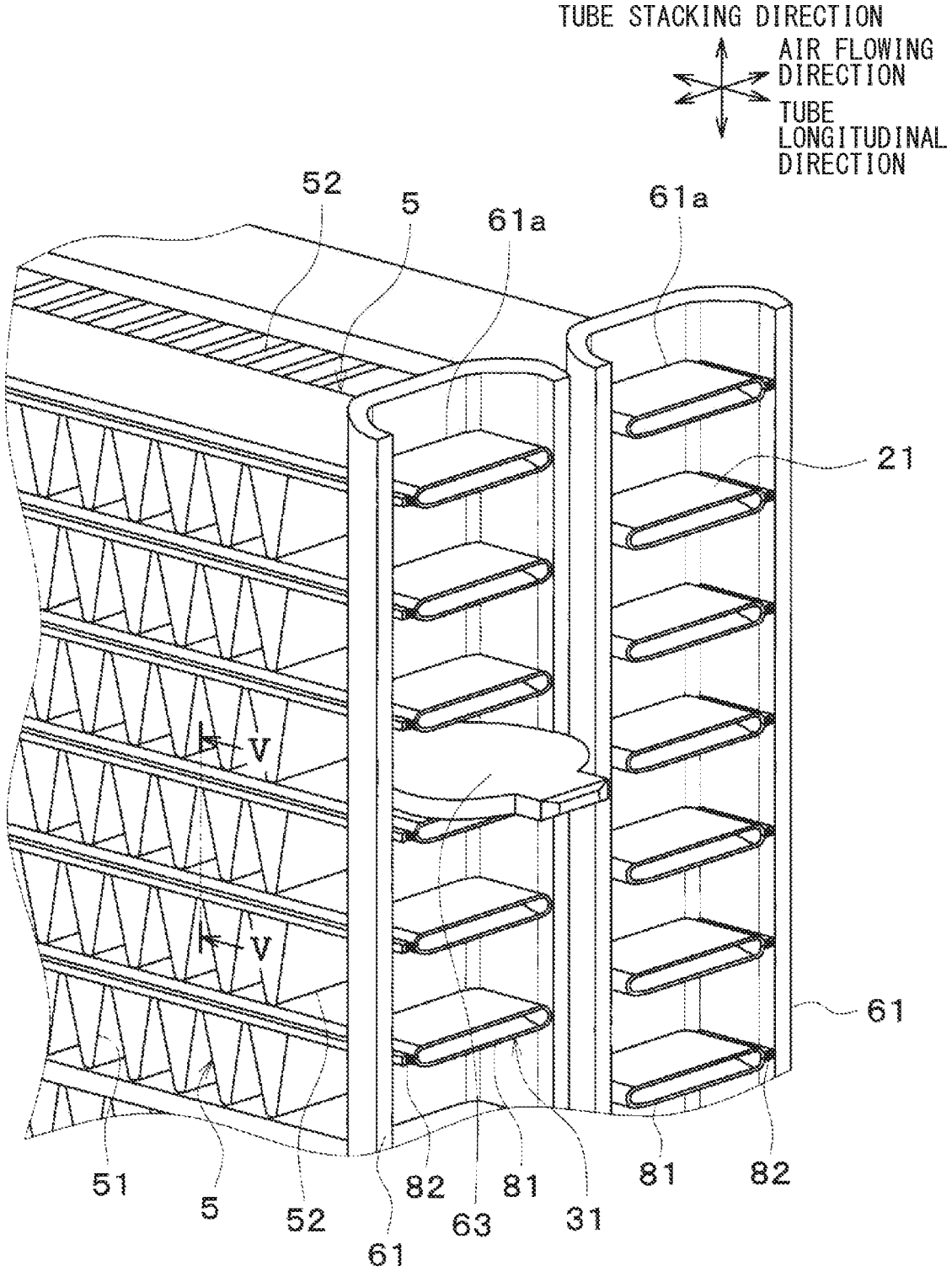
FIG. 2 is an enlarged view of a part II in FIG. 1.

As shown in FIGS. 1 and 2, the radiator 3 and the outdoor heat exchanger 2 are so-called tank-and-tube heat exchangers. The radiator 3 and the outdoor heat exchanger 2 have the same basic configuration.

The radiator 3 has an upstream tube 31, an upstream first tank 32, and an upstream second tank 33. The upstream tube 31 is a tubular member that allows cooling water, which is an internal fluid, to flow therethrough. The upstream tube 31 is formed of metal (for example, aluminum alloy) having excellent heat conductivity. Details of the upstream tube 31 will be described later.

The upstream first tank 32 is connected to one end of the upstream tube 31. The upstream first tank 32 is a header tank that distributes and collects cooling water to the upstream tube 31.

The upstream second tank 33 is connected to the other end of the upstream tube 31. The upstream second tank 33 is a header tank that distributes and collects cooling water to the upstream tube 31.

The upstream tubes 31 of the radiator 3 are stacked and arranged at regular intervals. Thereby, an air passage through which air flows is formed between the upstream tubes 31 adjacent to each other.

Hereinafter, the stacking direction of the upstream tubes 31 is referred to as a tube stacking direction. The longitudinal direction of the upstream tube 31 is called as a tube longitudinal direction.

An outer fin 5 is arranged in the air passage formed between the adjacent upstream tubes 31. The outer fin 5 is a heat transfer member that is joined to the outer surface of the upstream tube 31 to increase a heat exchange area with air.

The outer fin 5 is a corrugated fin formed by bending a thin plate material made of the same material as the upstream tube 31 into a wavy shape. That is, the cross-sectional shape of the outer fin 5 perpendicular to the air flowing direction is a wave shape having plural flat portions 51 that are substantially parallel to the air flowing direction and a top portion 52 that connects the flat portions 51 adjacent to each other. The outer fin 5 and the upstream tube 31 form a radiator core portion 300 that is a heat exchange unit for exchanging heat between cooling water and air.

The upstream first tank 32 and the upstream second tank 33 of the radiator 3 are made of the same material as the upstream tube 31 and are formed in a tubular shape. The upstream first tank 32 and the upstream second tank 33 are formed in a shape extending in the tube stacking direction.

Each of the upstream first tank 32 and the upstream second tank 33 includes a core plate 61 into which the upstream tube 31 is inserted and joined, and a tank body 62 that forms a tank space together with the core plate 61. The ends of the upstream tubes 31 in the tube longitudinal direction are brazed and joined while being inserted into the tube insertion holes 61*a* of the core plate 61.

An upstream partition member 63 is arranged inside each of the upstream first tank 32 and the upstream second tank 33. The upstream partition member 63 is disposed around the central portion inside of each of the upstream first tank 32 and the upstream second tank 33 in the stacking direction of the upstream tubes 31. The upstream partition member 63 in the upstream first tank 32 and the upstream partition member 63 in the upstream second tank 33 are arranged at the same position in the tube stacking direction.

The upstream partition member 63 is a partition that partitions each of the upstream first tank 32 and the upstream second tank 33 into two in the tube stacking direction. Each of the upstream first tank 32 and the upstream second tank 33 is partitioned by the upstream partition member 63 into an upstream upper tank portion 64 and an upstream lower tank portion 65.

The radiator core portion 300 has two tube groups (that is, flow path groups) arranged in the up-down direction. Hereinafter, the radiator core portion 300 has a first tube group 301 located on the upper side, and a second tube group 302 located on the lower side.

The upstream upper tank portion 64 communicates with the first tube group 301 of the upstream tubes 31. Cooling water for an engine (not shown) (hereinafter referred to as engine cooling water) flows through the upstream tubes 31 belonging to the first tube group 301. Therefore, the first tube group 301 of the radiator 3 corresponds to an engine radiator that cools the engine cooling water.

The upstream lower tank portion 65 communicates with the second tube group 302 of the upstream tubes 31. Cooling water for a device to be cooled (not shown) (hereinafter, referred to as device cooling water) flows through the upstream tube 31 belonging to the second tube group 302. Therefore, the second tube group 302 of the radiator 3 corresponds to a device radiator that cools the device cooling water. The device to be cooled may be an inverter that converts direct-current power supplied from a battery into alternating-current power to output the alternating-current power to a motor for the vehicle travelling.

The upstream first tank 32 is connected with an engine cooling water inlet 661 that allows the engine cooling water to flow into the tank space of the upstream upper tank portion 64, and a device cooling water inlet 662 that allows the device cooling water to flow into the tank space of the upstream lower tank portion 65. The upstream second tank 33 is connected with an engine cooling water outlet 663 for flowing out the engine cooling water from the tank space of the upstream upper tank portion 64, and a device cooling water outlet 664 for flowing out the device cooling water from the tank space of the upstream lower tank portion 65.

Similar to the radiator 3, the outdoor heat exchanger 2 includes a downstream tube 21, a downstream first tank 22, and a downstream second tank 23 to allow refrigerant to flow therethrough.

The downstream tube 21 has the same configuration as the upstream tube 31. The outer fin 5 is arranged in the air passage formed between the downstream tubes 21 adjacent to each other. The outer fin 5 and the downstream tube 21 form an outdoor heat exchanger core portion 200 which is a heat exchange unit for exchanging heat between the refrigerant and air. Details of the downstream tube 21 and the outer fin 5 will be described later.

The downstream first tank 22 and the downstream second tank 23 of the outdoor heat exchanger 2 are made of the same material as the downstream tube 21 and are formed in a tubular shape. The downstream first tank 22 and the downstream second tank 23 are formed in a shape extending in the tube stacking direction.

The downstream first tank 22 and the downstream second tank 23 are configured similarly to the upstream first tank 32 and the upstream second tank 33. That is, each of the downstream first tank 22 and the downstream second tank 23 has the core plate 61 and the tank body 62. The ends of the downstream tubes 21 in the tube longitudinal direction are brazed and joined in a state where they are inserted into the tube insertion holes 61*a* of the core plate 61.

A downstream partition member 67 is arranged inside the downstream second tank 23. The downstream partition member 67 is located at the lower position inside of the downstream second tank 23 in the stacking direction of the downstream tubes 21.

The downstream partition member 67 is a partition that partitions the downstream second tank 23 into two in the stacking direction of the downstream tubes 21. The downstream second tank 23 is partitioned by the downstream partition member 67 into a downstream upper tank portion 68 and a downstream lower tank portion 69.

The outdoor heat exchanger core portion 200 has two flow path groups arranged in the up-down direction. Hereinafter, the outdoor heat exchanger core portion 200 has a first passage group 201 located on the upper side, and a second passage group 202 located on the lower side. Further, among the downstream tubes 21 forming the outdoor heat exchanger core portion 200, the downstream tube 21 forming the first passage group 201 is referred to as a first downstream tube 21*a*, and the downstream tube 21 forming the second passage group 202 is called as a second downstream tube 21*b*.

The downstream upper tank portion 68 of the downstream second tank 23 communicates with the first passage group 201 of the outdoor heat exchanger core portion 200. The downstream lower tank portion 69 of the downstream second tank 23 communicates with the second passage group 202 of the outdoor heat exchanger core portion 200. That is, the downstream upper tank portion 68 communicates with the first downstream tube 21*a*, and the downstream lower tank portion 69 communicates with the second downstream tube 21*b*.

A refrigerant inlet port 665 for allowing the refrigerant to flow into the downstream upper tank portion 68 is provided at the upper side of the downstream partition member 67 in the downstream second tank 23. A refrigerant outlet port 666 for allowing the refrigerant to flow out from the downstream lower tank portion 69 is provided at the lower side of the downstream partition member 67 in the downstream second tank 23.

The refrigerant flows from the refrigerant inlet port 665 of the outdoor heat exchanger 2 into the downstream upper tank portion 68 of the downstream second tank 23. The refrigerant that has flowed into the downstream upper tank portion 68 flows in order of the first passage group 201 of the outdoor heat exchanger core portion 200, the tank internal space of the downstream first tank 22, and the second passage group 202 of the outdoor heat exchanger core portion 200, and flows into the downstream lower tank portion 69 of the downstream second tank 23. The refrigerant that has flowed into the downstream lower tank portion 69 flows out of the outdoor heat exchanger 2 through the refrigerant outlet port 666. As described above, the outdoor heat exchanger 2 of the present embodiment is configured such that the flow of the refrigerant makes one U-turn inside the outdoor heat exchanger 2.

A side plate 7 is provided at both ends of the radiator core portion 300 and the outdoor heat exchanger core portion 200 in the tube stacking direction to reinforce the radiator core portion 300 and the outdoor heat exchanger core portion 200. The side plate 7 extends parallel to the tube longitudinal direction. Both ends of the side plate 7 in the tube longitudinal direction are connected to the core plates 61 of the radiator 3 and the outdoor heat exchanger 2. The side plate 7 of this embodiment is made of metal such as aluminum alloy.

Subsequently, detailed configurations of the upstream tube 31 and the downstream tube 21 of the present embodiment will be described. In the present embodiment, the upstream tube 31 and the downstream tube 21 have the same configuration, so only the configuration of the upstream tube 31 will be described.

Figure 3:
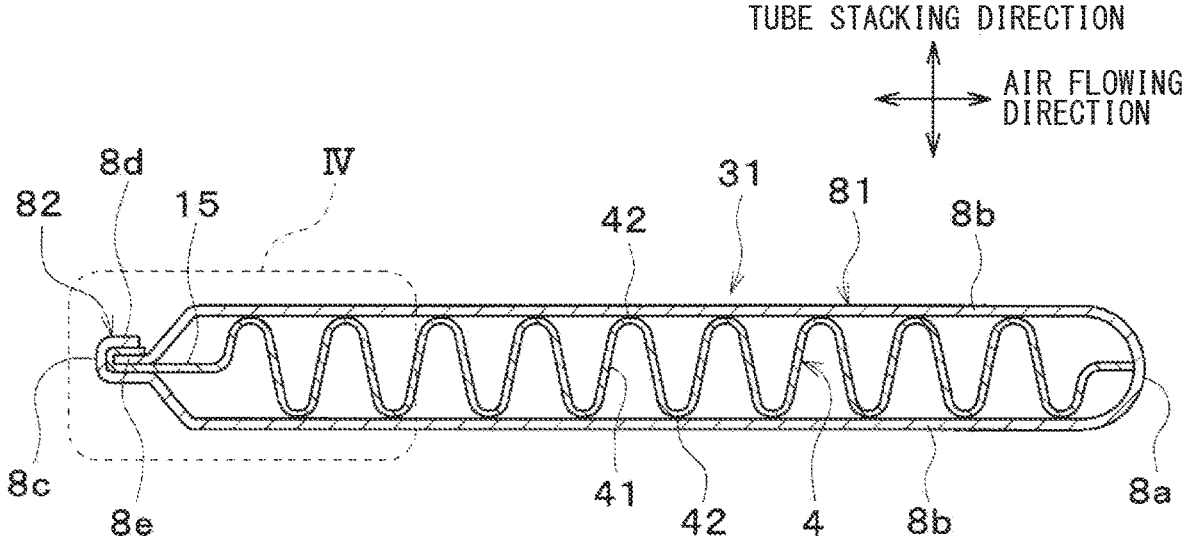
FIG. 3 is a cross-sectional view illustrating an upstream tube in the first embodiment.
Figure 4:
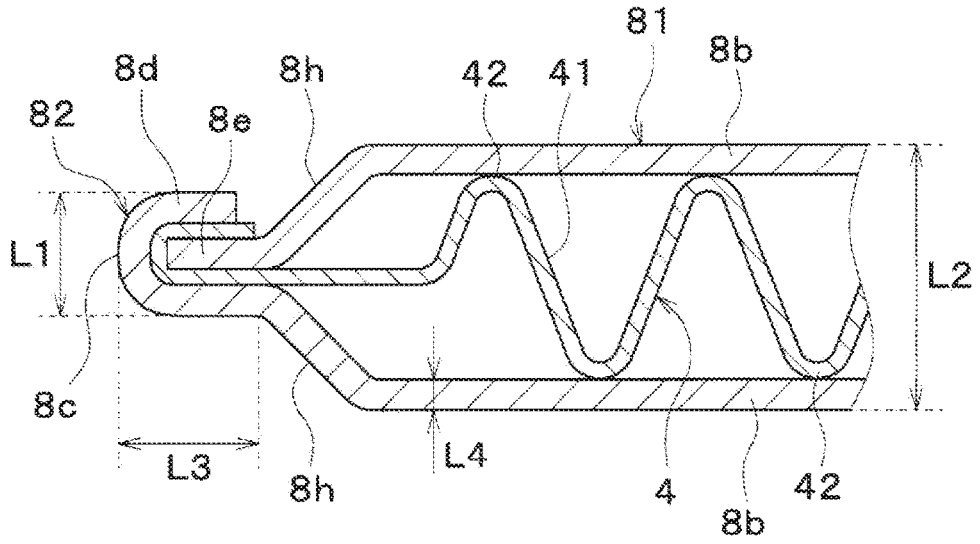
FIG. 4 is an enlarged view of a part IV in FIG. 3.

As shown in FIGS. 3 and 4, an inner fin 4 is provided inside the upstream tube 31. The inner fin 4 is a corrugated fin formed by bending a thin plate material made of the same material as the upstream tube 31 into a wavy shape. That is, the cross-sectional shape of the inner fin 4 perpendicular to the tube longitudinal direction is a corrugated shape having plural flat portions 41 that are substantially parallel to the tube longitudinal direction and a top portion 42 that connects the flat portions 41 adjacent to each other.

The upstream tube 31 has a tube body 81 and a protrusion 82. The tube body 81 is formed in a tubular shape, and is configured so that cooling water flows inside.

The protrusion 82 is connected to one end of the tube body 81 in the air flowing direction. The protrusion 82 is formed to protrude from the tube body 81 in the air flowing direction. The protrusion 82 is formed integrally with the tube body 81.

The upstream tube 31 of this embodiment is formed by bending a single plate member (that is, a flat plate). The plate member is formed of metal (for example, aluminum alloy) having excellent heat conductivity.

The upstream tube 31 includes a curved end 8*a* formed by folding a plate member, flat portions 8*b* arranged to face each other, and a crimping portion 8*c* provided at an end opposite to the curved end 8*a*. The crimping portion 8*c* is formed by folding one end portion 8*d* of the plate member opposite to the curved end 8*a* and by crimping so as to sandwich the other end portion 8*e* of the plate member and one end portion of the inner fin 4. The top portion 42 of the inner fin 4 is brazed and joined to the inner side of the flat portion 8*b*.

In the present embodiment, the crimping portion 8*c* corresponds to the protrusion 82. Further, the curved end 8*a* and the flat portions 8*b* form the tube body 81.

As shown in FIG. 4, the length dimension L1 of the protrusion 82 in the tube stacking direction is smaller than the length dimension L2 of the tube body 81 in the tube stacking direction. The length dimension L3 of the protrusion 82 in the air flowing direction is larger than the thickness L4 of the tube body 81. The thickness L4 of the tube body 81 means the thickness of the plate member forming the tube body 81.

Since the length dimension L1 of the protrusion 82 in the tube stacking direction is smaller than the length dimension L2 of the tube body 81 in the tube stacking direction, a step 8*h* is formed between the protrusion 82 and the flat portion 8*b*.

Figure 5:
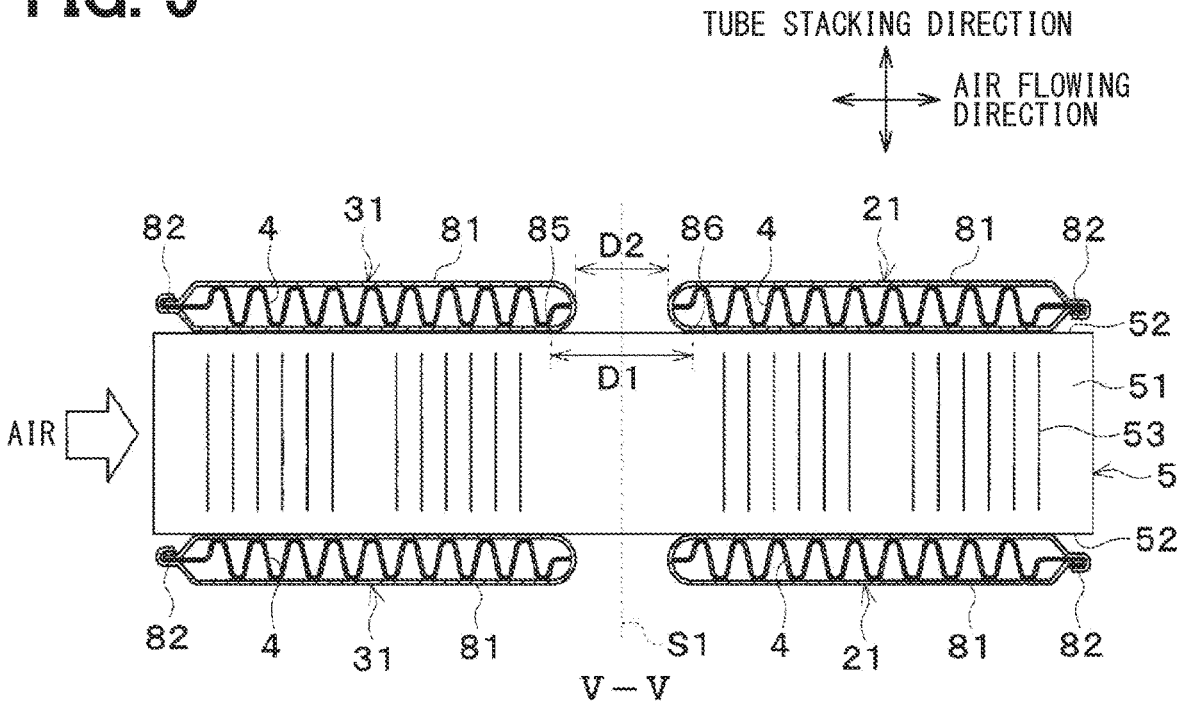
FIG. 5 is a cross-sectional view taken along a line V-V in FIG. 2.

As shown in FIG. 5, in the upstream tube 31, the protrusion 82 is connected to the upstream end of the tube body 81 in the air flowing direction. In the downstream tube 21, the protrusion 82 is connected to the downstream end of the tube body 81 in the air flowing direction.

Each of the outer fins 5 is joined to both the upstream tube 31 and the downstream tube 21 arranged in the air flowing direction. Specifically, the top portion 52 of the outer fin 5 is brazed to the surfaces of the flat portions 8*b* of the upstream tube 31 and the downstream tube 21. Therefore, heat conduction is performed between the upstream tube 31 and the downstream tube 21 via the outer fin 5.

Louvers 53 are integrally formed in the flat portion 51 of the outer fin 5 by cutting and raising 51. The louvers 53 are provided along the air flowing direction.

The engine cooling water or the device cooling water flows in the upstream tube 31 as an internal fluid. Refrigerant flows as an internal fluid in the downstream tube 21. Therefore, in the present embodiment, the internal fluid flowing through the upstream tube 31 and the internal fluid flowing through the downstream tube 21 are different type fluids and have different temperatures.

As described above, in the composite heat exchanger 1 of the present embodiment, the protrusion 82, in the upstream tube 31, is connected to the upstream end of the tube body 81 in the air flowing direction. Further, in the downstream tube 21, the protrusion 82 is connected to the downstream end of the tube body 81 in the air flowing direction.

Accordingly, as shown in FIG. 5, the distance D1 between the most downstream portion 85 of the joint between the upstream tube 31 and the outer fin 5 in the air flow and the most upstream portion 86 of the joint between the downstream tube 21 and the outer fin 5 in the air flow becomes short. Therefore, the thermal conductivity via the outer fin 5 between the upstream tube 31 and the downstream tube 21 can be improved. Therefore, it becomes possible to improve the thermal conductivity between the outdoor heat exchanger 2 and the radiator 3 which are arranged in series with respect to the air flowing direction.

Further, in the composite heat exchanger 1 of the present embodiment, it is not necessary to change the distance D2 between the upstream tube 31 and the downstream tube 21 as compared with a conventional composite heat exchanger. Therefore, the conventional core plate 61 and the like can be used as they are. Therefore, it is possible to improve the thermal conductivity between the outdoor heat exchanger 2 and the radiator 3 while suppressing changes in the existing configuration.

Further, as in the present embodiment, the protrusion 82 is connected to the upstream end of the tube body 81 in the air flowing direction, in the upstream tube 31 of the outdoor heat exchanger 2, so that it is possible to reduce the possibility that the tube body 81 is damaged by flying objects such as stones during the vehicle traveling. Therefore, the resistance to chipping can be improved.

Further, as in the present embodiment, the protrusion 82 is connected to the downstream end of the tube body 81 in the air flowing direction, in the downstream tube 21 of the outdoor heat exchanger 2, so that the step 8*h* is located downstream of the tube body 81 in the air flow, in the downstream tube 21. Therefore, when water is condensed on the outer surface of the downstream tube 21, the condensed water flows to the step 8*h*. Then, air flow causes the condensed water flowing to the step 8*h* to be discharged all at once. Therefore, the drainage of the condensed water can be improved.

That is, in the composite heat exchanger 1 of this embodiment, both the resistance to chipping and the drainage of the condensed water can be achieved.

In a conventional composite heat exchanger 1, the protrusion 82 is connected to the end of the tube body 81 on the same side in the air flowing direction in all of the upstream tube 31 and the downstream tube 21. In this case, one of the resistance to chipping and the drainage of the condensed water can be improved, but both cannot be improved (that is, not compatible).

Further, in the composite heat exchanger 1 of the present embodiment, as shown in FIG. 5, in the cross-section perpendicular to the tube longitudinal direction, the upstream tube 31 and the downstream tube 21 are formed symmetric with respect to a reference line S1 parallel to the tube stacking direction. Therefore, the tube insertion holes 61*a* of the core plate 61 can be made symmetric with respect to the reference line S1. As a result, the insertability of the upstream tube 31 and the downstream tube 21 can be improved. Therefore, the assemblability of the composite heat exchanger 1 can be improved.

Second Embodiment

A second embodiment will be described based on FIG. 6. The present embodiment is different from the first embodiment in the configuration of the upstream tube 31.

Figure 6:
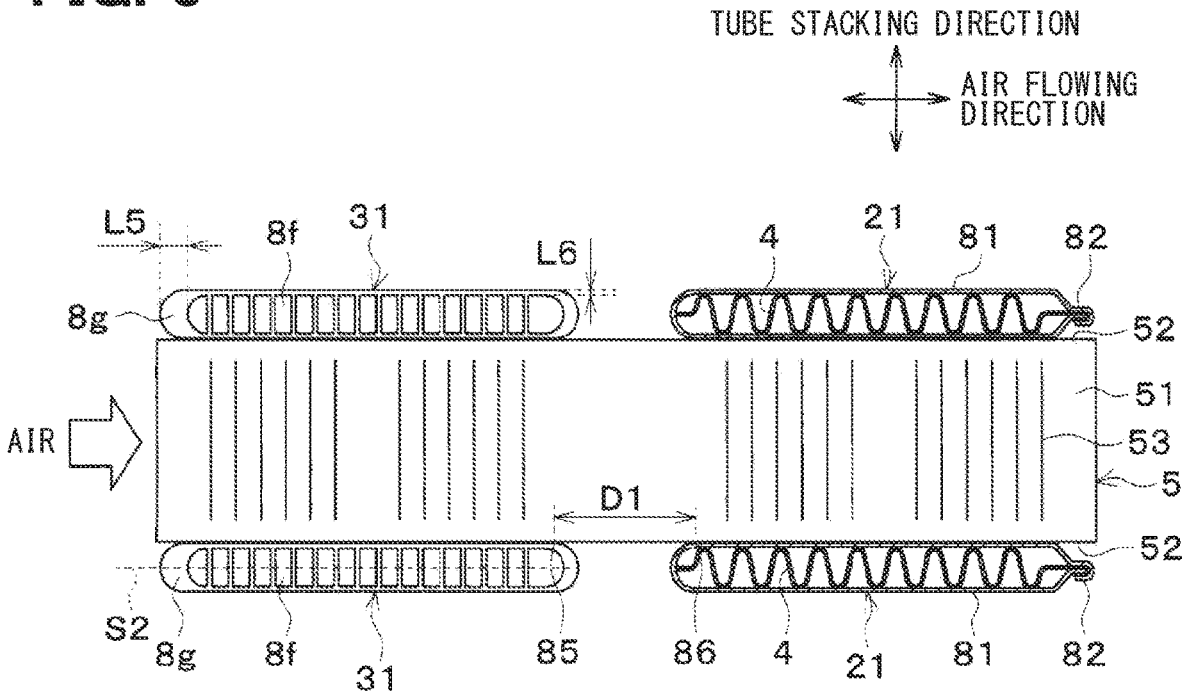
FIG. 6 is an enlarged cross-sectional view illustrating a part of a heat exchanger according to a second embodiment.

As shown in FIG. 6, the upstream tube 31 of the present embodiment is a multi-hole tube having plural small passages 8*f* inside. Such a multi-hole tube can be formed by extrusion molding. The cross-sectional shape of the upstream tube 31 perpendicular to the tube longitudinal direction is symmetric with respect to the center line S2 parallel to the air flowing direction. Further, in the upstream tube 31, the thickness L5 of the upstream end portion 8*g* in the air flowing direction is thicker than the thickness L6 of the other portion of the upstream tube 31.

According to the present embodiment, the distance D1 between the most downstream portion 85 of the joint between the upstream tube 31 and the outer fin 5 in the air flow and the most upstream portion 86 of the joint between the downstream tube 21 and the outer fin 5 in the air flow becomes shorter. Therefore, it is possible to obtain the same effect as that of the first embodiment.

Further, as in the present embodiment, in the upstream tube 31 of the outdoor heat exchanger 2, the thickness L5 of the upstream end portion 8*g* in the air flowing direction is made thicker than the thickness L6 of the other portion of the upstream tube 31, so that the resistance to chipping can be improved. Therefore, also in the composite heat exchanger 1 of the present embodiment, both the resistance to chipping and the drainage of condensed water can be achieved, as in the first embodiment.

The present disclosure is not limited to the above embodiments, and can be variously modified, for example, as described below, without departing from the gist of the present disclosure.

In the above-described embodiment, the upstream tube 31 and the downstream tube 21 are formed by bending one plate member and the protrusion 82 is configured by the crimping portion 8*c*. However, the configurations of the upstream tube 31, the downstream tube 21, and the protrusion 82 are not limited. For example, the upstream tube 31 and the downstream tube 21 may be formed by extrusion molding, and a rod-shaped or plate-shaped protrusion 82 may be integrally formed with the tube body 81.

The radiator 3 is adopted as the upstream unit and the outdoor heat exchanger 2 is adopted as the downstream unit in the above embodiment. The upstream unit and the downstream unit are not limited to these. For example, the outdoor heat exchanger 2 may be adopted for both the upstream unit and the downstream unit. In this case, both the internal fluid flowing through the upstream tube 31 and the internal fluid flowing through the downstream tube 21 are refrigerant. That is, the internal fluid flowing through the upstream tube 31 and the internal fluid flowing through the downstream tube 21 are the same type and have different temperatures.

In the above-described embodiment, the radiator 3 is configured to have both functions of an engine radiator and a device radiator, but the configuration of the radiator 3 is not limited to this. For example, the radiator 3 may be configured to have a function of either an engine radiator or a device radiator.

In the above-described embodiment, the two heat exchange units, e.g., the outdoor heat exchanger 2 and the radiator 3, are adopted as the plural heat exchange units, but three or more heat exchange units may be provided.

Although the present disclosure has been described in accordance with the embodiments, it is understood that the present disclosure is not limited to such examples or structures. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claimed is:

1. A heat exchanger configured to exchange heat between an external fluid and an internal fluid, the heat exchanger comprising:

a plurality of heat exchange units arranged in series in a flowing direction of the external fluid, wherein each of the plurality of heat exchange units including a plurality of tubes in which the internal fluid flows, and a plurality of outer fins joined to outer surfaces of the tubes to increase a heat exchange area with the external fluid, the tube has a tube body formed in a tubular shape, in which the internal fluid flows, and a protrusion connected to one end of the tube body in the flowing direction of the external fluid, a length dimension of the protrusion in a stacking direction of the tubes is smaller than a length dimension of the tube body in the stacking direction, a length dimension of the protrusion in the flowing direction of the external fluid is larger than a thickness of the tube body, the plurality of heat exchange units includes an upstream unit arranged on the most upstream side in the flowing direction of the external fluid and a downstream unit arranged downstream of the upstream unit in the flowing direction of the external fluid, the tubes forming the upstream unit is defined as an upstream tube and the tubes forming the downstream unit is defined as a downstream tube, each of the outer fins is joined to both the upstream tube and the downstream tube arranged in the flowing direction of the external fluid, the protrusion of the upstream tube is connected to an upstream end of the tube body in the flowing direction of the external fluid, and the protrusion of the downstream tube is connected to a downstream end of the tube body in the flowing direction of the external fluid.

2. A heat exchanger configured to exchange heat between an external fluid and an internal fluid, the heat exchanger comprising:

a plurality of heat exchange units arranged in series in a flowing direction of the external fluid, wherein each of the plurality of heat exchange units including a plurality of tubes in which the internal fluid flows, and a plurality of outer fins joined to outer surfaces of the tubes to increase a heat exchange area with the external fluid, the plurality of heat exchange units includes an upstream unit arranged on the most upstream side in the flowing direction of the external fluid and a downstream unit arranged downstream of the upstream unit in the flowing direction of the external fluid, the tubes forming the upstream unit is defined as an upstream tube and the tubes forming the downstream unit is defined as a downstream tube, each of the outer fins is joined to both the upstream tube and the downstream tube arranged in the flowing direction of the external fluid, a cross-sectional shape of the upstream tube perpendicular to a longitudinal direction of the upstream tube is symmetric with respect to a center line of the upstream tube parallel to the flowing direction of the external fluid, a thickness of an upstream end portion of the upstream tube in the flowing direction of the external fluid is larger than a thickness of the other portion of the upstream tube, the downstream tube has a tube body formed in a tubular shape, in which the internal fluid flows, and a protrusion connected to a downstream end of the tube body in the flowing direction of the external fluid, a length dimension of the protrusion in a stacking direction of the tubes is smaller than a length dimension of the tube body in the stacking direction, and a length dimension of the protrusion in the flowing direction of the external fluid is larger than a thickness of the tube body.

3. The heat exchanger according to claim 1, wherein the internal fluid flowing through the upstream tube and the internal fluid flowing through the downstream tube are different types or have different temperatures.

4. The heat exchanger according to claim 1, wherein the internal fluid flowing through the upstream tube and the internal fluid flowing through the downstream tube are the same type and have different temperatures.

* * * * *